US006899320B1

(12) United States Patent
Wallace

(10) Patent No.: US 6,899,320 B1
(45) Date of Patent: May 31, 2005

(54) CHAIN LINK FENCE TIGHTENING ASSEMBLY

(76) Inventor: Donald Wallace, P.O. Box 1147, Raymond, NH (US) 03077

( * ) Notice: Subject to any disclaimer, the term of this patent is extended or adjusted under 35 U.S.C. 154(b) by 0 days.

(21) Appl. No.: 10/802,888

(22) Filed: Mar. 18, 2004

(51) Int. Cl.[7] ..... B25B 25/00
(52) U.S. Cl. ..... 254/222; 254/217; 254/224; 24/133
(58) Field of Search ..... 254/213, 217, 254/222, 224; 24/132 R, 133

(56) References Cited

U.S. PATENT DOCUMENTS

| | | | | | |
|---|---|---|---|---|---|
| 956,328 | A | * | 4/1910 | Forshee | 74/156 |
| 1,059,678 | A | | 8/1913 | Conley | |
| 1,267,308 | A | * | 5/1918 | Belgard | 254/217 |
| 1,494,484 | A | * | 5/1924 | Hudspeth | 254/217 |
| 2,331,390 | A | | 10/1943 | Gustafson | |
| 2,451,389 | A | * | 10/1948 | Howe | 254/222 |
| 2,769,613 | A | * | 11/1956 | Blosick | 254/219 |
| 3,337,927 | A | * | 8/1967 | Dresie | 24/132 R |
| 3,949,968 | A | * | 4/1976 | Verhelst | 254/213 |
| 3,993,288 | A | | 11/1976 | Pfarr, Jr. | |
| 4,148,466 | A | | 4/1979 | Wilson | |
| 4,264,055 | A | | 4/1981 | Strange | |
| 4,298,185 | A | * | 11/1981 | Janssen | 256/41 |
| 5,988,595 | A | | 11/1999 | DeVincent | |

* cited by examiner

*Primary Examiner*—Emmanuel Marcelo

(57) ABSTRACT

A chain link fence tightening assembly for stretching a chain link fence adjacent to and beyond a first vertical post and toward a second vertical post such that the chain link fence may be attached to the first vertical post in a taut manner includes an elongated rod that is selectively coupled to a plurality of links of the chain link fence. A gripping member removably grips the second vertical post. A first cable and a second cable each have a first end and a second end. The first end of the first cable is attached to the rod and the first end of the second cable is attached to the gripping member. A winding assembly is attached to each of the first and second cables and is adapted for pulling the rod and the gripping member toward each other such that the chain link fence is pulled taut.

5 Claims, 4 Drawing Sheets

CHAIN LINK FENCE TIGHTENING ASSEMBLY

BACKGROUND OF THE INVENTION

1. Field of the Invention

The present invention relates to chain tightening devices and more particularly pertains to a new chain tightening device for stretching a chain link fence for the purpose of ensuring it is tight before being attached to vertical support posts.

2. Description of the Prior Art

The use of chain tightening devices is known in the prior art. U.S. Pat. No. 4,264,055 describes a pole having a hook therein for attaching to and stretching a chain link fence upwardly toward a horizontal pole support. Another type of chain tightening device is U.S. Pat. No. 5,988,595 which includes a plate that has a free end with prongs for engaging a chain link fence. The plate has an arcuate portion for abutting a post. A rod is attached to the plate and is used for leverage to pull the fence tighter. A tether ties the end of the rod to the fence to hold it in place while the fence is attached to the post.

While these devices fulfill their respective, particular objectives and requirements, the need remains for a device that provides more tension in the fence than the previously known methods so that the fence does not sag or warp after an extended time of being hung on vertical posts. The device should be designed so that a solo acting fence installer may use it for mounting chain link fence on vertical posts.

SUMMARY OF THE INVENTION

The present invention meets the needs presented above by including a winding assembly for pulling the fence tight between a pair of primary posts so that it is pulled tight along a one or more secondary posts. Once pulled tight, the fence may be attached to the secondary posts.

Another object of the present invention is to provide a new chain tightening device that allows a fence to be tightened, and held in a tightened manner, by one person.

To this end, the present invention generally comprises a chain link fence tightening apparatus for stretching a chain link fence adjacent to and beyond a first vertical post and toward a second vertical post such that the chain link fence may be attached to the first vertical post in a taut manner. The apparatus includes an elongated rod that is selectively coupled to a plurality of links of the chain link fence. A gripping member removably grips the second vertical post. A first cable and a second cable each have a first end and a second end. The first end of the first cable is attached to the rod and the first end of the second cable is attached to the gripping member. A winding assembly is attached to each of the first and second cables and is adapted for pulling the rod and the gripping member toward each other such that the chain link fence is pulled taut.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
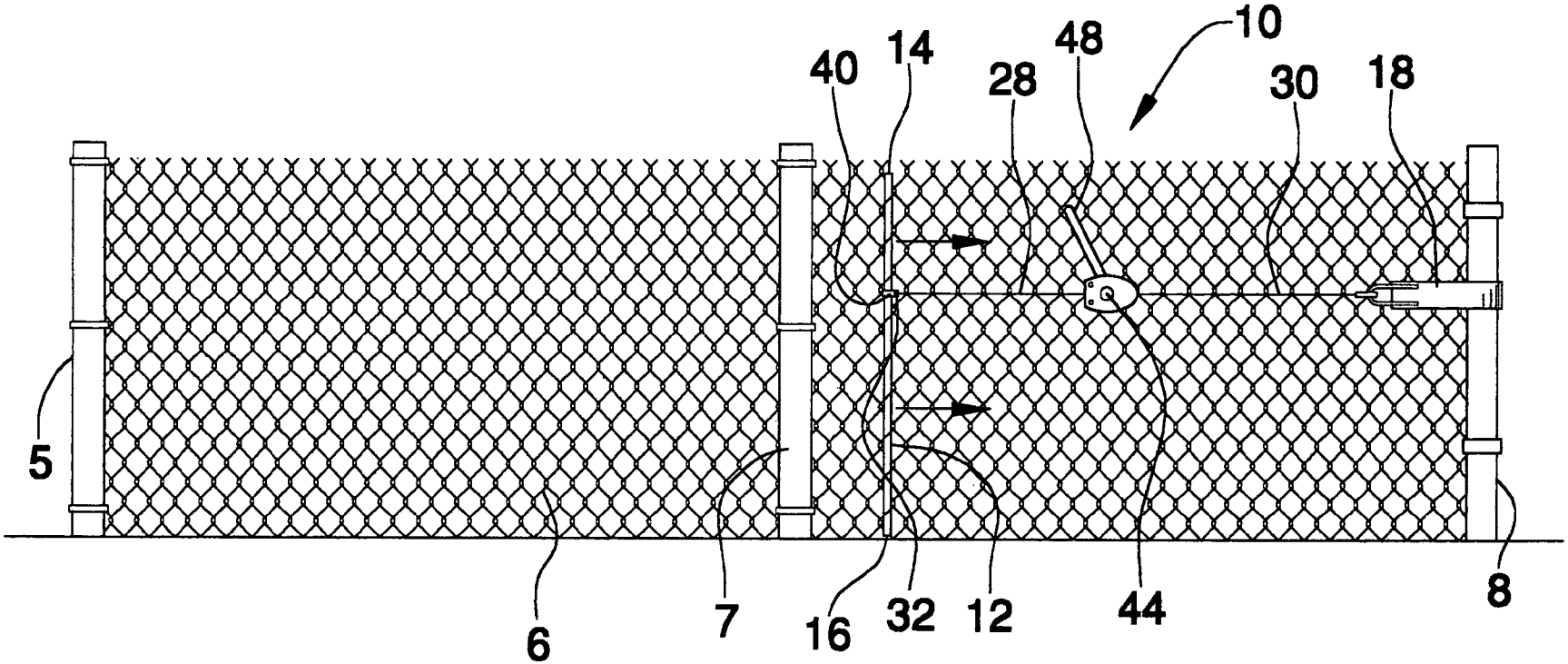
FIG. 1 is a front environmental view of a chain link fence tightening assembly according to the present invention.
Figure 2:
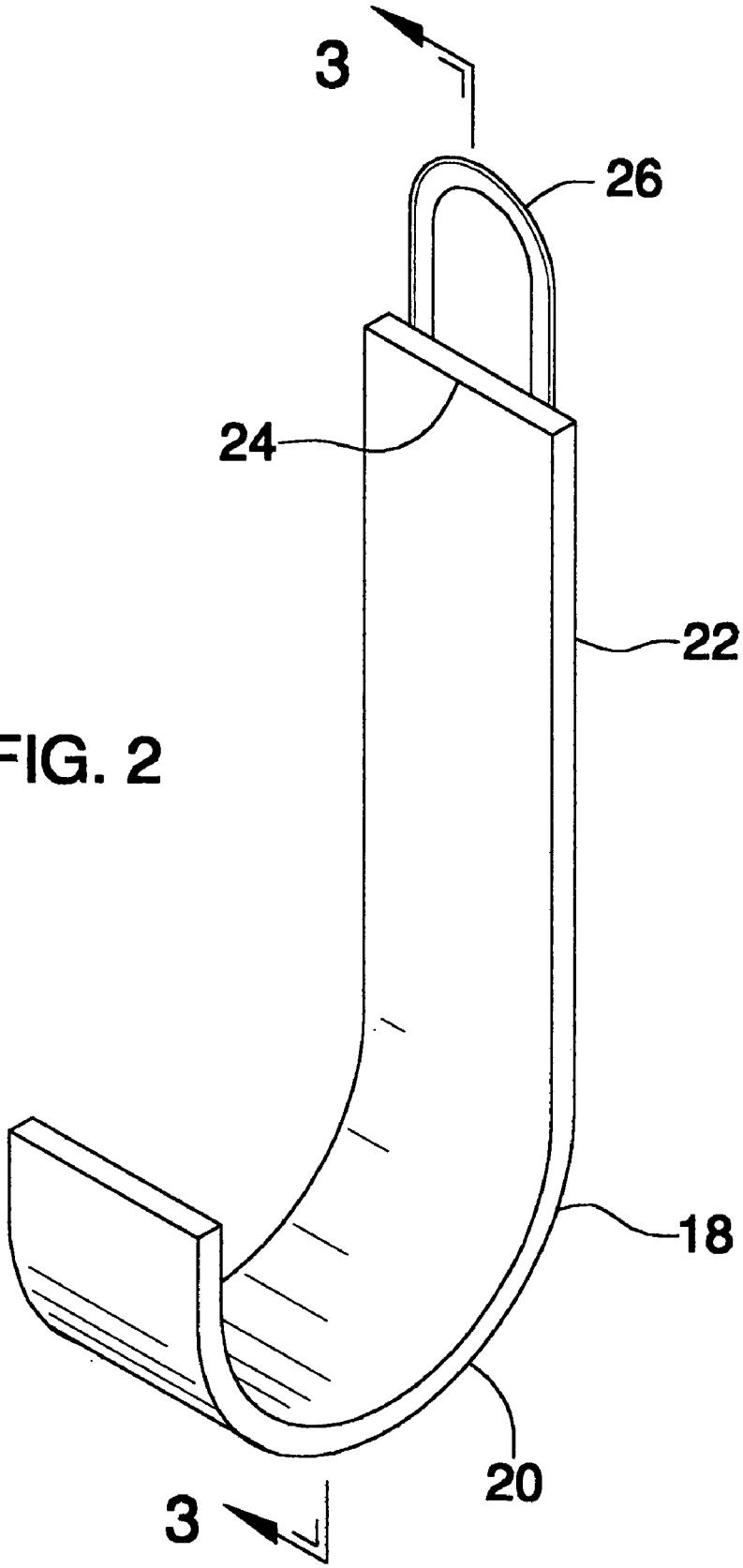
FIG. 2 is a schematic perspective view of the gripping member of the present invention.
Figures 3, 4:
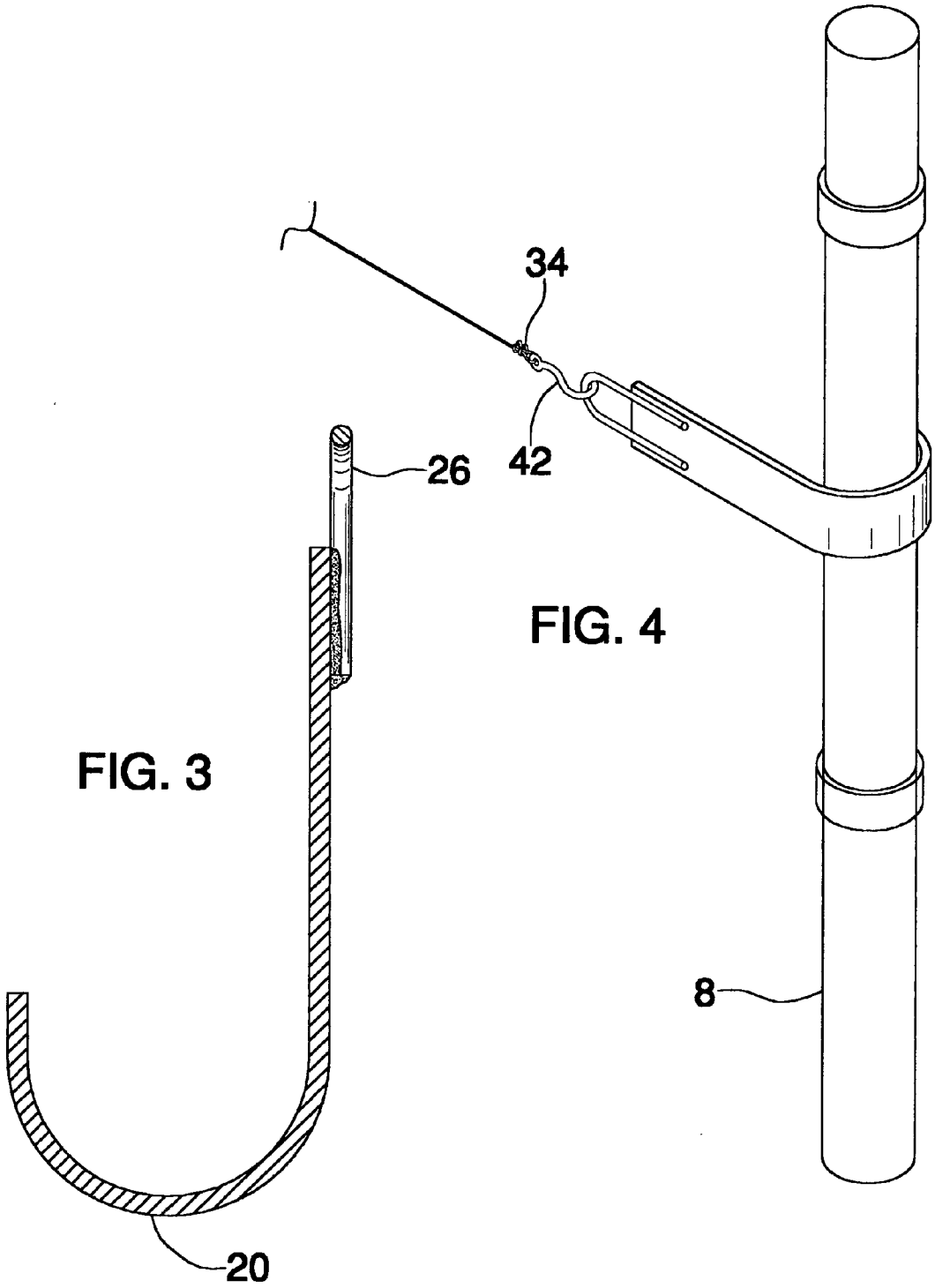
FIG. 3 is a cross-sectional view taken along line 3—3 of FIG. 2 of the present invention.
FIG. 4 is a perspective in-use view of the gripping member of the present invention.

With reference now to the drawings, and in particular to FIGS. 1 through 5 thereof, a new chain tightening device embodying the principles and concepts of the present invention and generally designated by the reference numeral 10 will be described.

As best illustrated in FIGS. 1 through 5, the chain link fence tightening assembly 10 generally comprises an assembly adapted for stretching a chain link fence 6 adjacent to and beyond a first vertical post 7 and toward a second vertical post 8. Once tightened, the fence 6 may be attached to the first vertical post 7 in a taut manner.

The assembly 10 includes an elongated rod 12 having a first end 14 and a second end 16. The rod 12 is rigid has a length greater than two feet. The rod 12 is coupled to the fence 6 by threading the rod 12 through the chain link fence 6. It is preferred that the rod 12 is mounted on the chain link fence 6 in a substantially vertical orientation.

A gripping member 18 is provided for removably gripping the second vertical post 8. The gripping member 18 includes a hook that has a curved foot portion 20 and a leg 22 extending away from the foot 20 such that the gripping member 18 is generally J-shaped. The leg 22 has a free end 24. It is preferred that a loop member 26 is attached to the free end 24 of the leg 22.

A first cable 28 and a second cable 30 each have a first end 32, 34 and a second end 36, 38, respectively. The first end 32 of the first cable 28 is removably attached to the rod 12 with a hook 40. The first end 34 of the second cable 30 is removably attached to the loop member 26 with a hook 40. If the loop member 26 is not used, the first end 34 of the second cable 30 may be attached directly to the gripping member 18 by a conventional fastening means or through an aperture that may be extended through the leg 22 of the gripping member 18. The first 28 and second 30 cables are preferably constructed of a metallic material though synthetic materials of sufficient strength may also be utilized.

Figure 5:
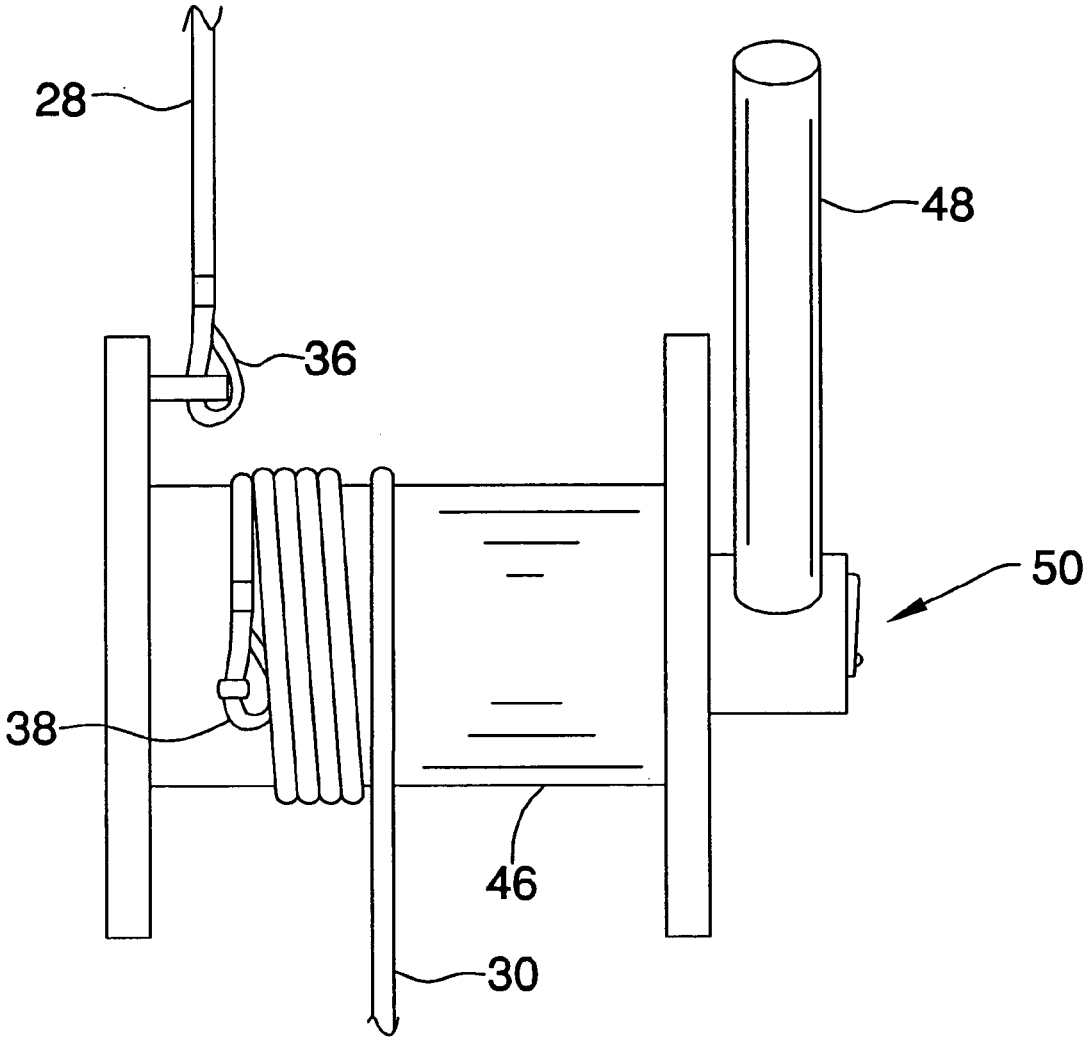
FIG. 5 is a schematic top view of the winding assembly of the present invention.

A winding assembly 44 is attached to the second end 36 of the first cable 28. The winding assembly 44 preferably includes a spool 46 and an actuator 48 for rotating the spool 46. The actuator 48 preferably includes a conventional ratcheting apparatus 50 as shown in FIG. 5, through an electric motor may also be utilized. The second end 38 of the second cable 30 is attached to the spool 46. The winding assembly 44 is adapted for selectively winding or unwinding the second cable 30 onto the spool 46.

In use, the fence 6 is attached to a base post 5 and the fence extended by the first post 7 and toward the second post 8. The rod 12 is threaded through the fence 6 at a point between 6 and 10 feet from the second post 8. The gripping member 18 is positioned on the second vertical post 8. The winding assembly 44 winds the second cable 30 onto the spool 46 such that the fence 6 is pulled toward the second vertical post 8. Once the fence 6 is sufficiently tight, binding members are used to attach the fence 6 to the first vertical post 7. At this point, the rod 12 should be within a few feet of the second post 8 and the fence 6 may also be bound to the second post 8. The winding member 44 is then unwound so that the gripping member 18 may be removed from the second vertical post 8 and the rod 12 removed from the fence 6. There may be additional intervening posts between the base post 5 and the second post 8 to which the fence may also be attached.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A chain link fence tightening apparatus for stretching a chain link fence adjacent to and beyond a first vertical post and toward a second vertical post such that the chain link fence may be attached to the first vertical post in a taut manner, said apparatus comprising:

an elongated rod being selectively coupled to a plurality of links of the chain link fence;

a gripping member for removably gripping the second vertical post;

a first cable and a second cable each having a first end and a second end, said first end of said first cable being attached to said rod, said first end of said second cable being attached to said gripping member;

a winding assembly being attached to each of said first and second cables and adapted for pulling said rod and said gripping member toward each other such that the chain link fence is pulled taut.

2. A chain link fence tightening apparatus for stretching a chain link fence adjacent to and beyond a first vertical post and toward a second vertical post such that the chain link fence may be attached to the first vertical post in a taut manner, said apparatus comprising:

an elongated rod having a first end and a second end, wherein said rod may be threaded through the chain link fence such that the rod is mounted on the chain link fence in a substantially vertical orientation;

a gripping member for removably gripping the second vertical post;

a first cable and a second cable each having a first end and a second end, said first end of said first cable being attached to said rod, said first end of said second cable being attached to said gripping member;

a winding assembly being attached to said second end of said first cable, said winding assembly including a spool attached to said second end of said second cable, said winding assembly being adapted for winding or unwinding said second cable onto said spool; and wherein said gripping member may be positioned on the second vertical post and said winding assembly may wind said second cable onto said spool such that the chain link fence is pulled toward the second vertical post.

3. The apparatus according to claim 2, wherein said rod has a length greater than two feet.

4. The apparatus according to claim 2, wherein said gripping member includes a hook having a curved foot portion and a leg extending away from said foot such that said gripping member is generally J-shaped, said leg having a free end.

5. A chain link fence tightening apparatus for stretching a chain link fence adjacent to and beyond a first vertical post and toward a second vertical post such that the chain link fence may be attached to the first vertical post in a taut manner, said apparatus comprising:

an elongated rod having a first end and a second end, said rod being rigid having a length greater than two feet, wherein said rod may be threaded through the chain link fence such that the rod is mounted on the chain link fence in a substantially vertical orientation;

a gripping member for removably gripping the second vertical post, said gripping member including a hook having a curved foot portion and a leg extending away from said foot such that said gripping member is generally J-shaped, said leg having a free end, a loop member being attached to said free end of said leg;

a first cable and a second cable each having a first end and a second end, said first end of said first cable being removably attached to said rod, said first end of said second cable being removably attached to said loop member;

a winding assembly being attached to said second end of said first cable, said winding assembly including a spool attached to said second end of said second cable, said winding assembly being adapted for winding or unwinding said second cable on said spool; and wherein said gripping member may be positioned on the second vertical post and said winding assembly may wind said second cable onto said spool such that the chain link fence is pulled toward the second vertical post.

* * * * *